US005484364A

United States Patent [19]

Boring

[11] Patent Number: 5,484,364

[45] Date of Patent: Jan. 16, 1996

[54] ADJUSTABLE STRIKING BAG SUPPORT APPARATUS

[76] Inventor: Richard J. Boring, 1109 Mulberry Rd., Brunswick, Ohio 44212

[21] Appl. No.: 60,458

[22] Filed: May 7, 1993

[51] Int. Cl.[6] ..... A63B 69/00

[52] U.S. Cl. ..... 482/87; 482/83; 482/908

[58] Field of Search ..... 482/104, 83–86, 482/87, 88–90, 904, 908; 273/55 A, 55 R

[56] References Cited

U.S. PATENT DOCUMENTS

| | | | |
|---|---|---|---|
| 554,756 | 2/1896 | Westaway | 482/87 |
| 732,396 | 6/1903 | Cunningham | 482/87 |
| 992,868 | 5/1911 | Gorman | 482/87 |
| 1,046,397 | 12/1912 | Medart | 482/87 |
| 1,553,664 | 9/1925 | Bergmann | 482/87 |
| 2,659,603 | 11/1953 | Glasser | 482/87 |
| 4,302,009 | 11/1981 | Johnson | 482/104 |
| 4,512,568 | 4/1985 | Servadio | 482/87 |
| 4,662,630 | 5/1987 | Digward et al. | 482/87 |

OTHER PUBLICATIONS

Everlast Catalog–Acrobic Exercise and Physical Fitness Products (1992).

Ringside Products Brochure (undated).

*Primary Examiner*—Richard J. Apley

*Assistant Examiner*—Jerome Donnolly

*Attorney, Agent, or Firm*—Ralph E. Jocke

[57] ABSTRACT

An adjustable striking bag support apparatus (10) includes a fixed frame portion (16) with a movable frame portion (18) mounted thereon. The movable frame portion includes upper projecting members (56) that are engageable with tab projections (36) that extend upwardly and outwardly from the fixed frame portion. The movable frame portion also includes lower projecting members (58) movable in vertically extending slots (46). A pair of hand screws (64) are used to lock the frame portions in fixed relative position. Vertical adjustment of the striking bag is achieved by loosening the hand screws and moving the movable frame portion by a handle (60) upwardly and outwardly so as to disengage the adjacent tab projections. Thereafter, the movable frame portion may be moved vertical to the desired level and re-engaged with a tab projection which thereafter supports the movable frame portion at the desired level. The hand screws are then retightened to lock the movable frame portion in position.

21 Claims, 8 Drawing Sheets

ADJUSTABLE STRIKING BAG SUPPORT APPARATUS

TECHNICAL FIELD

This invention relates to athletic training apparatus. Specifically this invention relates to an apparatus for supporting a striking bag for training of boxers which is vertically adjustable to suit the height of the individual.

BACKGROUND ART

Various types of apparatus are known in the prior art for supporting a striking bag. The most common type of striking bag is known as a "speed bag" in the sport of boxing. The simplest type of speed bag support includes brackets which extend in cantilevered fashion from a vertical wall. A platform with a horizontally extending lower surface is mounted to the brackets. The speed bag extends downward from the platform. When the fighter strikes the bag it is deflected and bounces off the platform into position to be struck again. Working the speed bag helps to build coordination and quickness.

A speed bag that is mounted with simple brackets to a wall is suitable for use only by boxers within a limited height range. In facilities where many boxers train it is desirable to have the height of the speed bag and platform vertically adjustable so that individuals of varying heights may use the speed bag for training purposes.

Many approaches have been taken in the prior art to make a striking bag supporting apparatus vertically adjustable. Some are as simple as mounting the platform and bag from a pair of spaced brackets that include vertical slots. Fasteners extend through the slots and can be fixed at the desired height. The problem with this approach is that the slotted supporting members are inherently weak and not very durable. Such devices may also take considerable time to adjust and are prone to become loose due to vibration. The loosening of the platform and speed bag from its mounting may be a serious problem as it may fall on the individual using the speed bag.

Other approaches that have been taken to making a speed bag vertically adjustable include mounting the platform to a carrier that is movable on vertically extending tracks. The carrier includes locking fasteners that lock the carriage at the desired height along the track. Such devices provide a better support but are often difficult to adjust. In some designs the fasteners which must be loosened and tightened, are overhead which makes it difficult for an individual to adjust the height. Adjustment of such devices may also require the individual to support the weight of the platform and speed bag for an extended period of time.

An improvement on the track and carriage speed bag support has included the use of a worm gear drive to move the platform vertically. The use of a worm gear drive enables an individual to adjust the height of the speed bag by turning a crank or other member which is readily accessible. However, the worm gear drive system adds both cost and weight to the device.

Thus, there exists a need for speed bag support apparatus that is durable, readily adjustable and low in cost.

DISCLOSURE OF INVENTION

It is an object of the present invention to provide an apparatus for supporting a striking bag that is readily adjustable.

It is a further object of the present invention to provide an apparatus for supporting a striking bag that is adjustable by a single individual.

It is a further object of the present invention to provide an apparatus for supporting a striking bag that is durable and able to withstand vibration and impact.

It is a further object of the present invention to provide an apparatus for supporting a striking bag that is economical to manufacture.

It is a further object of the present invention to provide an apparatus for supporting a striking bag that is readily installed.

It is a further object of the present invention to provide an apparatus for supporting a striking bag that is easy to assemble anti which has few parts.

Further objects of the present invention will be made apparent in the following Best Mode for Carrying Out Invention and the appended claims.

The foregoing objects are accomplished in the preferred embodiment of the present invention by a striking bag support apparatus having a first frame portion that is attached to a wall or other supporting surface, The first frame portion includes a pair of spaced upright members, The upright members include a back flange surface which extends the length of the members.

A plurality of vertically spaced tab projections extend outward and upward in the area near the top of the upright members. An overlying projection extends above the tab projections on the upright members and is outwardly spaced therefrom.

Inwardly extending projections are positioned in a lower area of each upright member, The inwardly extending projections and the back flange portion bound a vertically extending slot means.

A second movable frame portion is mounted for movement on the first frame portion. The second frame portion has projecting members at a top end which are adapted to engage the tab projections. The movable frame portion further includes projecting members at its lower end which are adapted for acceptance and movement in the vertical slot means of the upright members. The projecting members at the top are movable in the area between the overlying projections and the tab projections so that the second frame portion may be moved vertically to engage the tab projections at the desired height for the speed bag.

The movable frame portion has arms mounted thereon which extend outward and are adapted for mounting a conventional speed bag platform. The movable frame portion also includes a handle at its lower end so that it may be manually moved upward or downward to the desired height.

The second frame portion also includes brackets which have a pair of hand screws extending therethrough. The hand screws may be tightened so that the movable frame portion is fixed in position on the first frame portion. The hand screws are adapted to engage projections overlying the vertically extending slot means and to fix the movable frame portion in position by clamping action.

Adjustment of the height of the speed bag is accomplished by loosening the hand screws and moving the movable frame portion upward with the handle at the lower end while moving the movable frame portion slightly outward. Moving the movable frame portion upward and outward causes the projecting members at the upper end of the movable frame portion to move out of engagement with the immediately adjacent tab projections. The movable frame portion may then be moved into engagement with tab projections at the desired height. Once the movable frame portion is engaged to the tab projections at the desired height, the hand screws are retightened to lock the frame portions in fixed relative position.

BEST MODES FOR CARRYING OUT INVENTION

Figure 1:
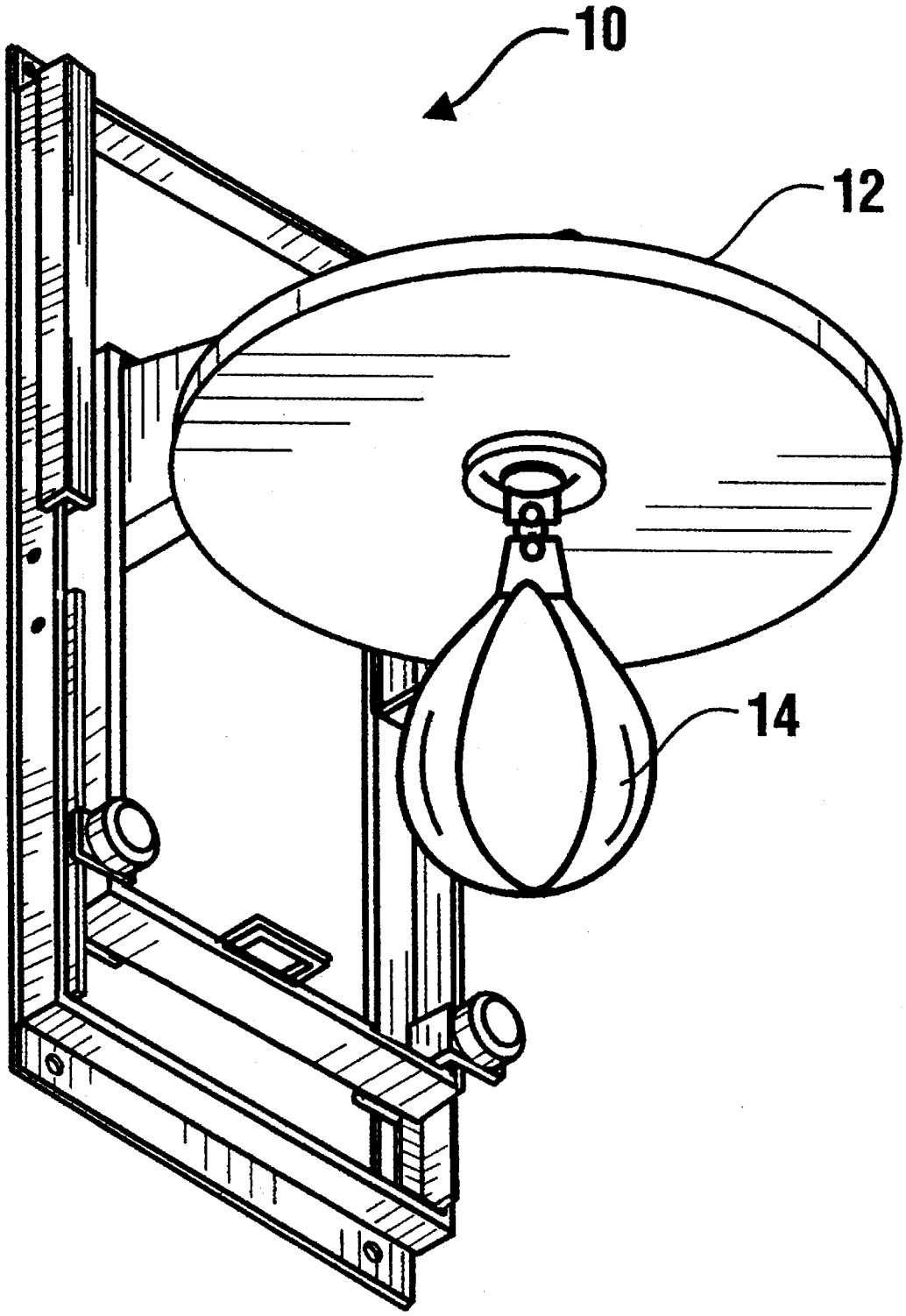
FIG. 1 is an isometric view of the preferred embodiment of the adjustable striking bag support apparatus of the present invention shown with a conventional platform and striking bag mounted thereon.

Referring now to the drawings and particularly to FIG. 1, there is shown therein the preferred embodiment of the vertically adjustable striking bag support apparatus of the present invention generally indicated 10. The apparatus is shown supporting a conventional platform 12 with a speed bag 14 mounted thereto.

Figure 2:
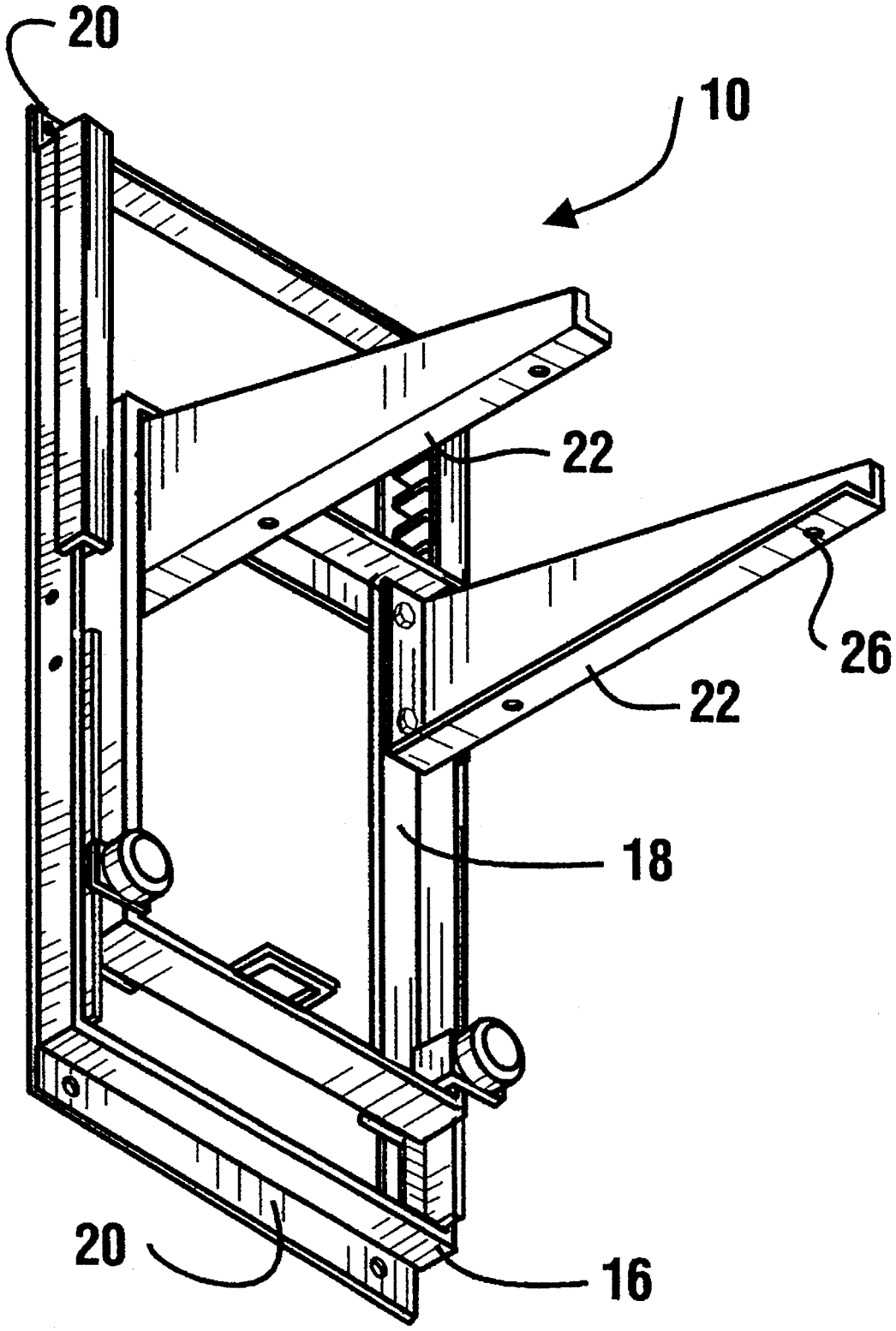
FIG. 2 is an isometric view of the striking bag support apparatus of FIG. 1 with the platform and bag removed.
Figure 3:
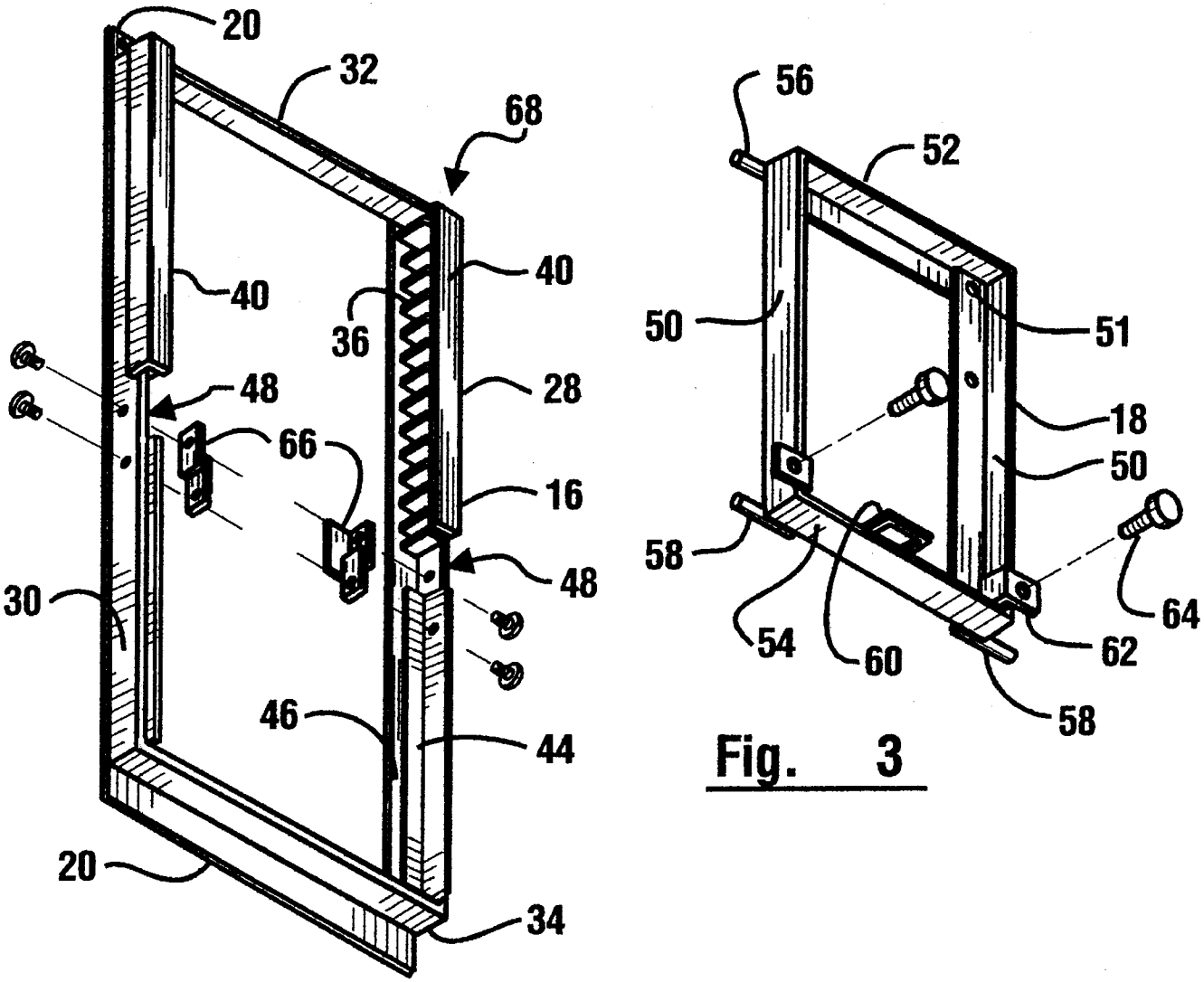
FIG. 3 is an exploded view of the striking bag support apparatus.

The supporting apparatus 10 is shown with the platform and bag removed in FIGS. 2 and 3. The apparatus includes a fixed frame portion 16 and a movable frame portion 18. The fixed frame portion includes external mounting flanges 20 at its upper and lower ends to facilitate mounting the apparatus to a wall or to another vertically extending supporting surface.

Figure 6:
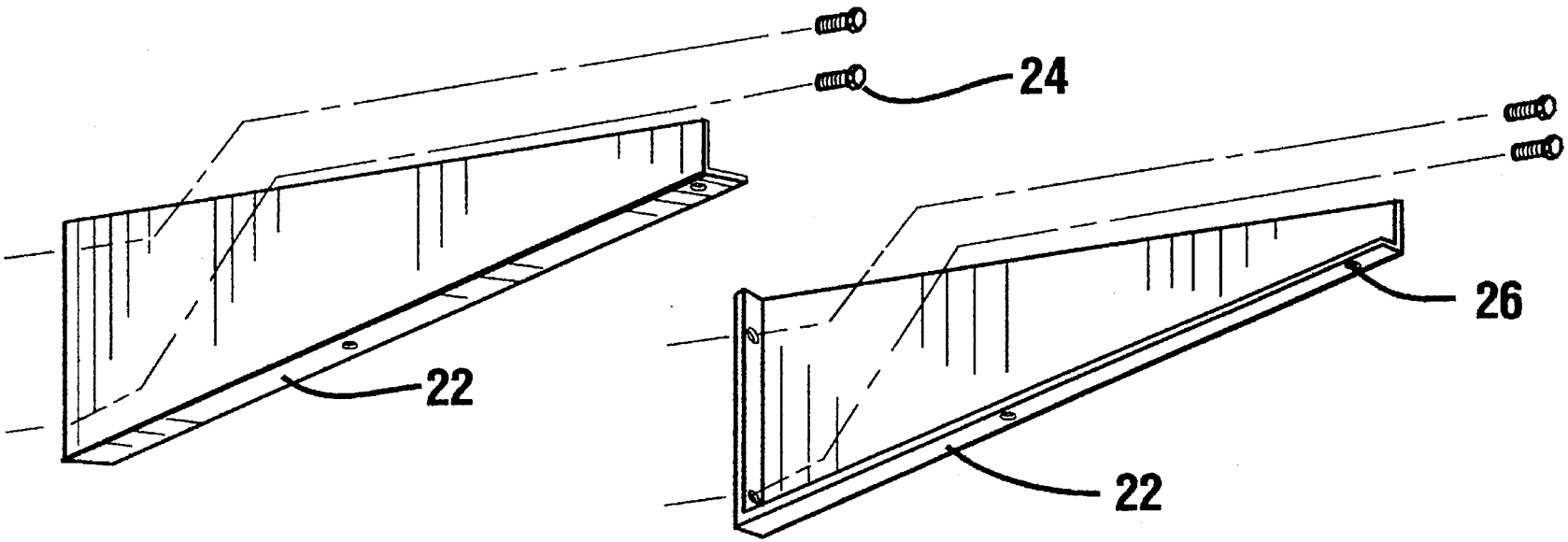
FIG. 6 is an isometric view of the platforms supporting arms of the striking bag support apparatus.

The movable frame portion has arm portions 22 mounted thereto (See FIG. 6). The arm portions are adapted for supporting a conventional platform and speed bag. The arm portions are attached to the movable frame portion 18 by bolts 24. Holes 26 in the arm portions except conventional fasteners (not shown) that are adapted to hold the platform thereto.

As shown in FIG. 3 fixed frame portion 16 includes a pair of spaced upright members 28, 30. Fixed frame portion 16 further includes a top wall member 32 and a bottom wall member 34 which extend between the upright members. Mounting flanges 20 extend from the top wall member and the bottom wall member.

Figure 8:
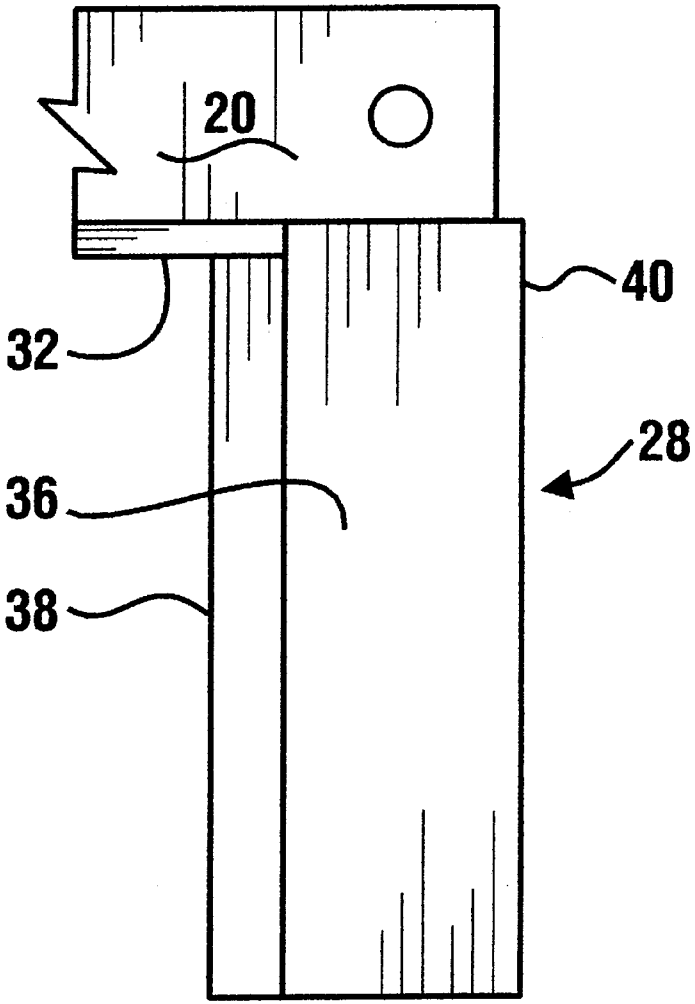
FIG. 8 is a front plan view of the portion of the upright member shown in FIG. 7.

Each upright member 28, 30 includes a plurality of vertically spaced tab projections 36. The tab projections 36 extend outwardly and upwardly from a back flange portion 38, The back flange portion 38 extends the length of the upright members (See FIG. 7–8). The tab projections 36 serve as member accepting means as later explained.

Figure 7:
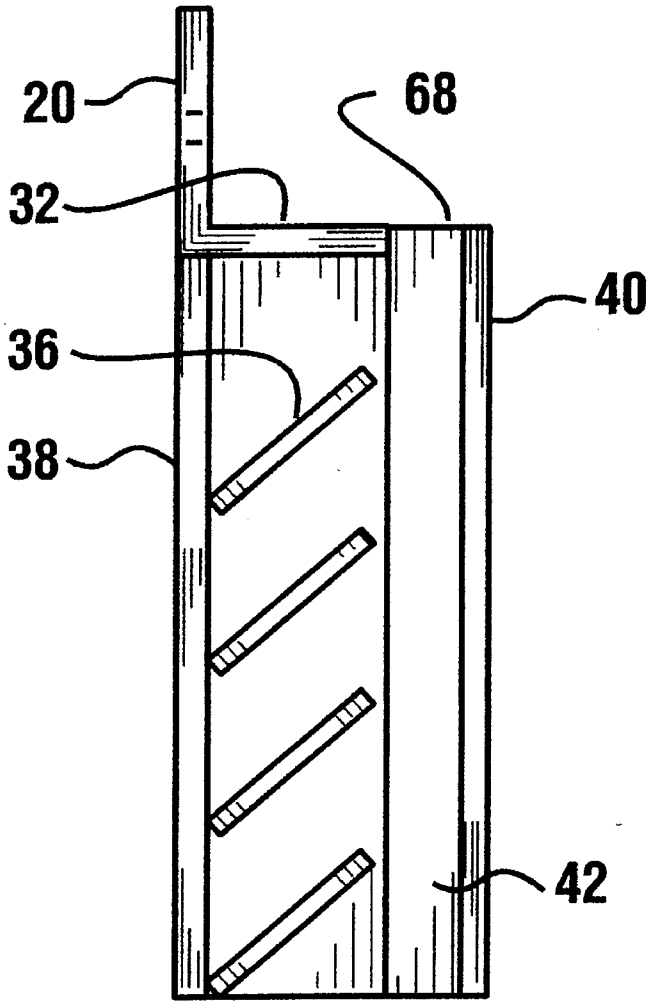
FIG. 7 is a left side view of an upper portion of an upright member of the fixed frame portion of the apparatus.

Each upright member includes an external overlying projection 40, which in the preferred embodiment, is the leg of an angle overlying the tab projections and spaced therefrom. A vertical access opening 42 extends intermediate of the tab projections and the overlying projection. Access opening 42 is closed by top wall member 32 as shown in FIG. 7.

Figure 10:
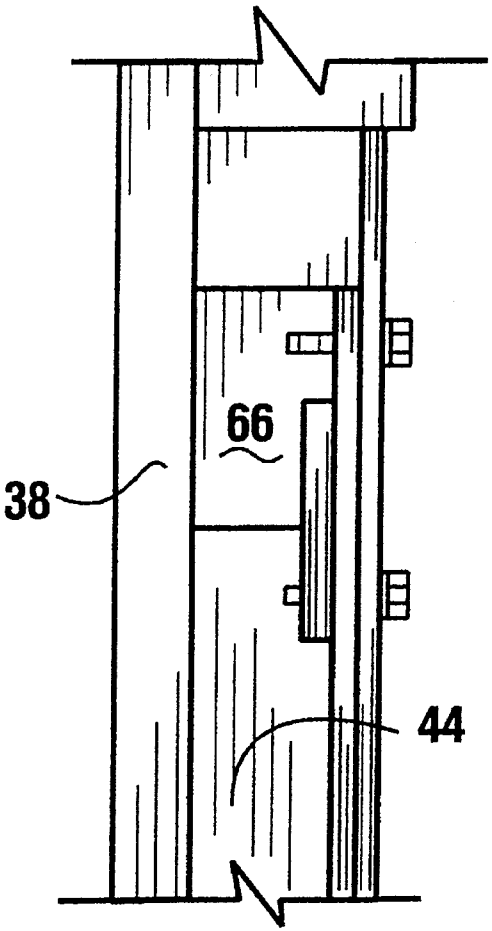
FIG. 10 is a front plan view of the central portion of the upright member and closing member shown in FIG. 9.

Upright members 38, 40 further each include internal overlying projections 44 which in the preferred embodiment are the leg of an angle. Overlying projections 44 and back flange portions 38 bound vertically extending slots 46 (See FIGS. 9–10). Slots 46 are closed at the lower end by bottom wall member 34. Clearance areas 48 extend between the overlying projections 40, 44 near the middle of upright members 28, 30.

Movable frame portion 18 includes a pair of side channels 50, a top channel 52 and a bottom channel 54. The side channels 50 include holes 51 for accepting bolts 24 for enabling the mounting of arm portions 22 to the movable frame portion. A pair of first projecting rod members 56 extend horizontally from the top of movable frame portion 18. A pair of second projecting rod members 58 extend from a lower portion of movable frame portion 18. The bottom channel 54 has a handle 60 mounted thereon.

L-shaped brackets 62 extend from side channels 50. Brackets 62 each include a threaded opening therein for accepting hand screws 64.

Figure 4:
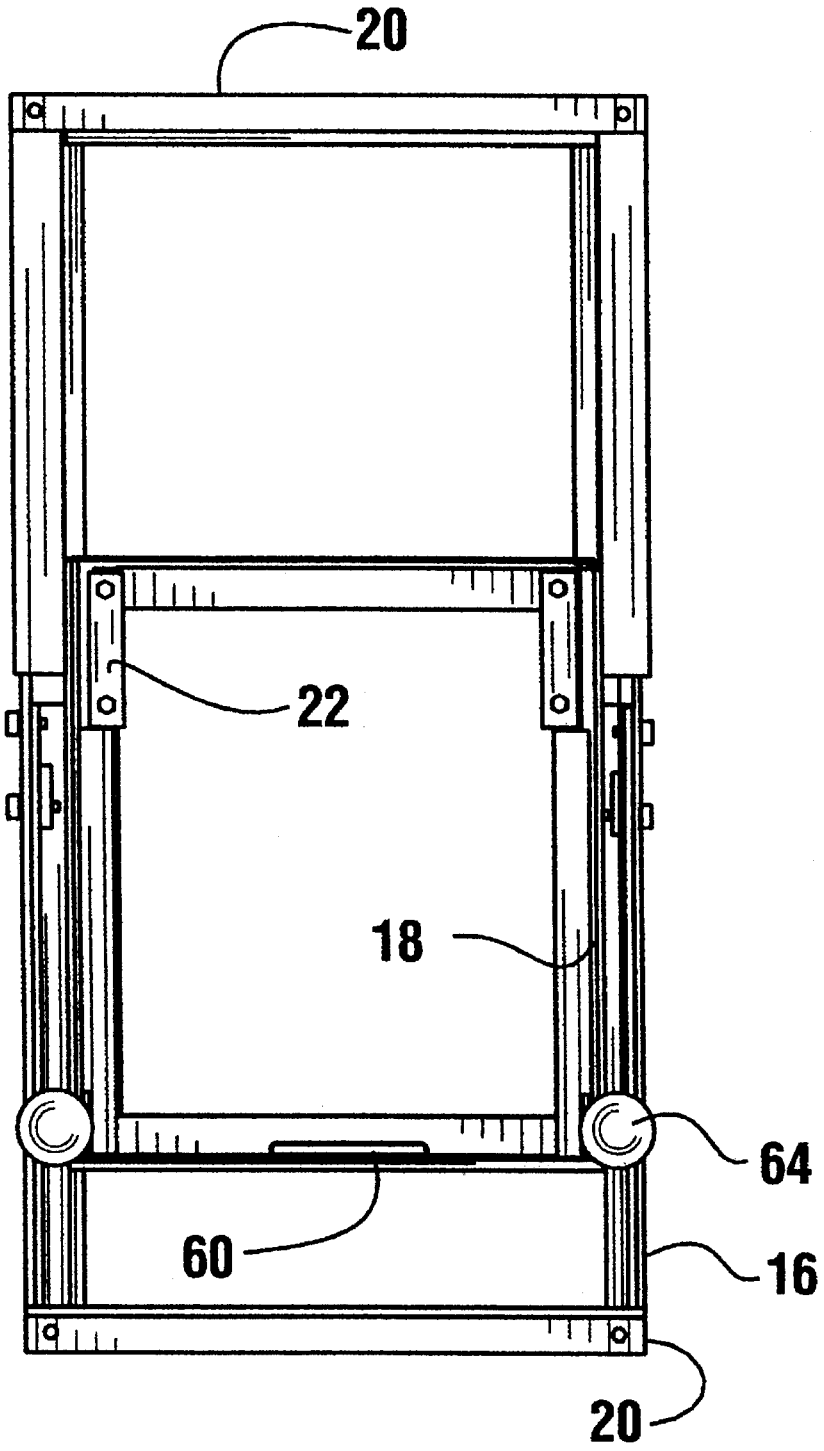
FIG. 4 is a front plan view of the striking bag support apparatus.
Figure 5:
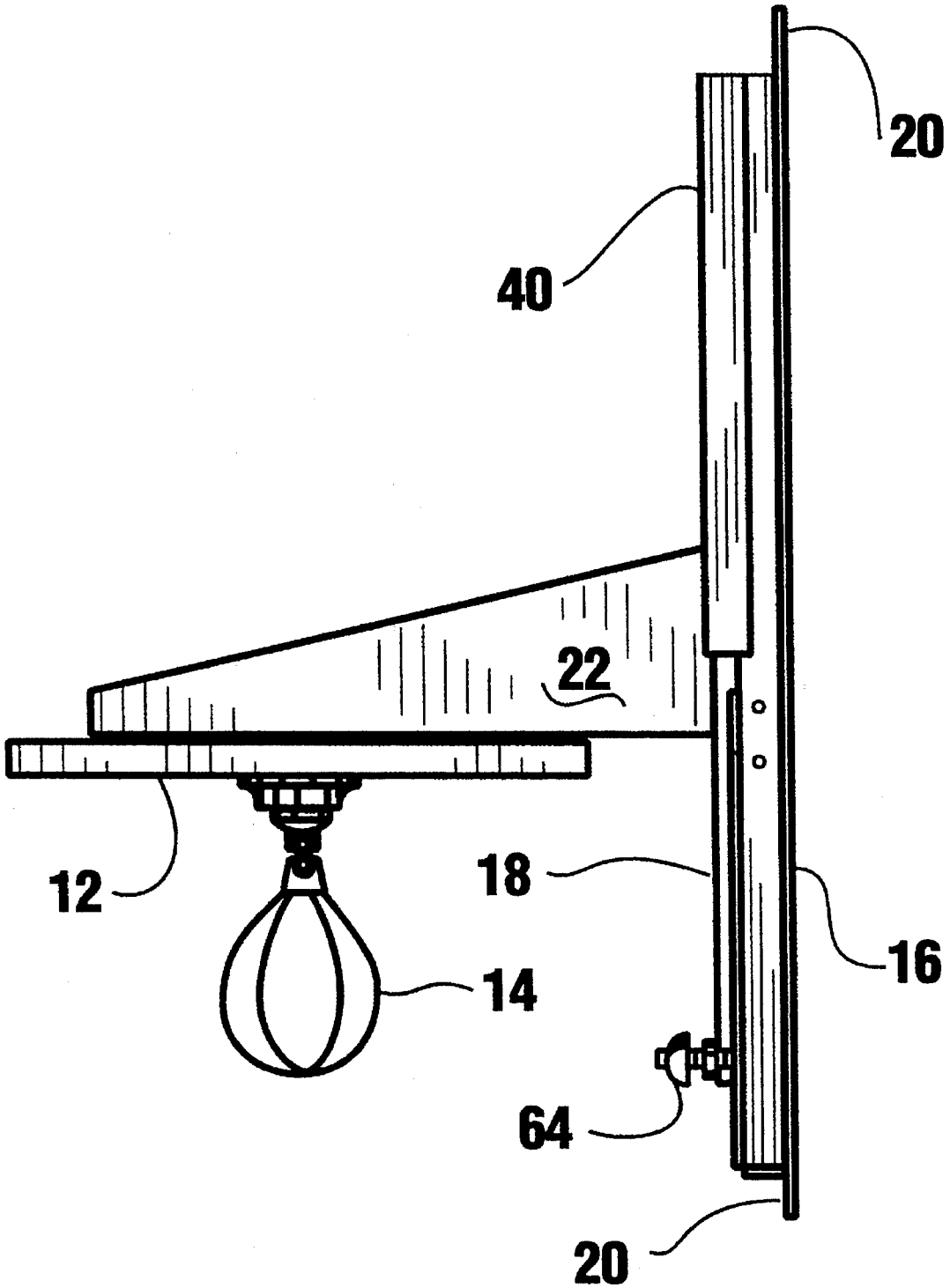
FIG. 5 is a right side view of the striking bag support apparatus with the striking bag and platform shown mounted thereon.

In the assembled condition of the apparatus 10 is shown in FIGS. 2, 4 and 5, movable frame portion 18 is mounted on fixed frame portion 16. Projecting rod members 56 extend intermediate of overlying projections 40 and back flange portion 38, and are adapted for selective engagement with one of the tab projections 36. Rod portions 58 extend and are movable in slots 46 intermediate of overlying projection 44 and back flange portion 38.

The projecting rod members are installed and the frame portions of the apparatus by first passing members 56 through clearance openings 68 which extend between top wall member 32 and projections 40 (see FIG. 7). Rod members 56 are then moved through vertical access opening 42 toward clearance area 48. When members 56 are moved into vertical access opening 42, rod members 58 are disposed so that they may be moved into clearance areas 48. Thereafter, moving the movable frame portion 18 downward toward bottom wall member 34 causes members 58 to be captured in the vertically extending slots 46. Once frame portion 18 is in this position, closing members 66 are installed in clearance areas 48.

Figure 9:
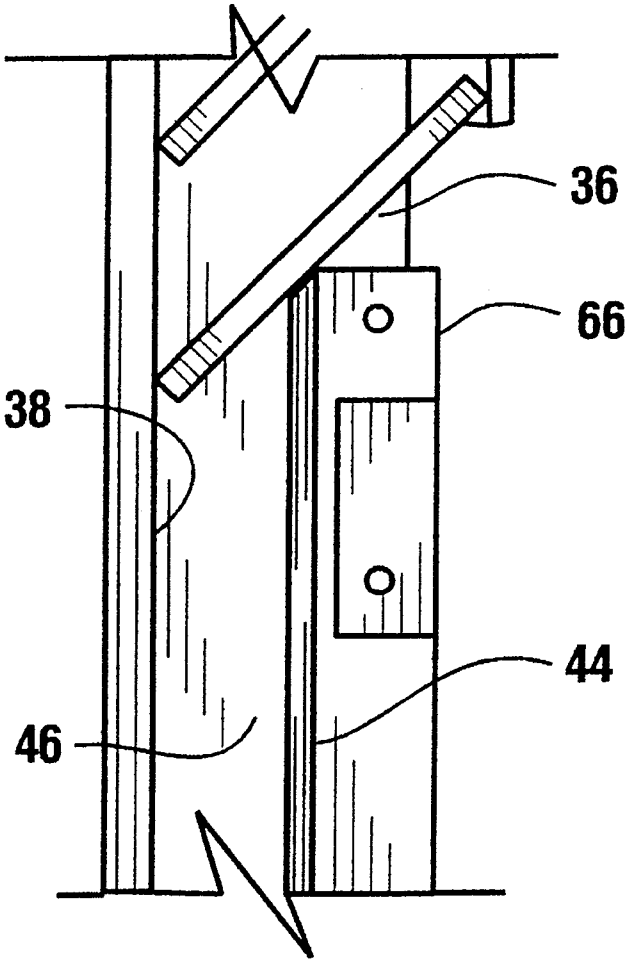
FIG. 9 is a left side view of a central portion of an upright member with a closing member mounted therein.

As best shown in FIG. 9 each closing member 66 extends and encloses the vertically extending slots 46 so that access thereto is blocked by the lowest of the tab projections 36. Closing members 66 are fixed in place on the upright members 28, 30 using conventional fasteners as shown. With the closing members in place the fixed and movable frame portions cannot be disengaged.

The height of the platform 12 and the attached striking bag 14 is adjusted by first loosening hand screws 64. With the hand screws loosened, handle 60 is manually engaged and pushed upward as the movable frame portion is tilted slightly outward. As projecting rod members 56 move upward and outward, they slide away from the angled tab projections above he ones to which they were previously engaged, and move into the vertical access openings 42 in the upright members. The movable frame portion is then moved upward or downward as desired using the handle 60. When the desired height is reached, an inward push of the movable frame portion causes rod members 56 to move back and engage the adjacent tab projection 36. Once engaged to a tab projection rod members 56 move downwardly and rearwardly thereon in nesting relation to back flange portion 38.

The movable frame portion is thereafter secured by tightening hand screws 64. Hand screws 64 engage overlying projections 44 and clamp the projections between the hand screws and the rod members 58 which extend below the projections 44. The clamping action of the hand screws secures the movable frame portion in a fixed position on the fixed frame portion through long periods of repeated vibration and impact.

The height of the platform and bag may be readily adjusted to the height of another boxer by loosening the hand screws and repeating the process. The adjustment is readily made by one person from ground level. No special tools are required. The adjustment does not necessitate the person making the adjustment of carrying the full weight of the platform for an extended period of time, as it may be ratcheted up and down between the tab projections. Also during the adjusting process the movable frame portion cannot be disengaged from the fixed frame portion.

Although the preferred embodiment of the present invention is shown as comprised of standard angle and rod stock, in other embodiments it may be made of cast material. Further, those skilled in the art will understand that the invention may be made in different embodiments to suit the type and size of the striking bag to be supported.

Thus, the vertically adjustable striking bag support apparatus of the present invention achieves the above stated objectives, eliminates difficulties encountered in the use of prior devices, solves problems, and attains the desirable results described herein.

In the foregoing description certain terms have been used for brevity, clarity and understanding, however, no unnecessary limitations are to be implied therefrom because such terms are for descriptive purposes and are intended to be broadly construed. Moreover, the descriptions and illustrations are by way of examples and the invention is not limited to the exact details shown and described.

Having described the features, discoveries and principles of the invention, the manner in which it is constructed and operated, and the advantages and useful results attained; the new and useful structures, devices, elements, arrangements, parts, combinations, systems, equipment, operations and relationships are set forth in the appended claims.

I claim:

1. A vertically adjustable striking bag support support apparatus, comprising:

a fixed frame means, said fixed frame means adapted for attachment to a generally vertically extending support surface;

said fixed frame means including vertically extending slot means in a lower portion thereof, and a plurality of vertically spaced member accepting means in an upper portion thereof;

a movable frame means adapted for vertical movement on said fixed frame means, said movable frame means including an arm portion said arm portion extending from said movable frame means in a direction away from said support surface said arm portion adapted for holding a platform and striking bag in supported relation therewith;

said movable frame means including slot engaging member means for engagement in said slot means and adapted for vertical movement therein;

said movable frame means further including a projection member means on upper portion thereof for selective engagement with said spaced member accepting means, whereby said projection member means is held in supported relation by said accepting means at a selected vertical elevation.

2. The apparatus according to claim 1 wherein said fixed frame means includes a first overlying projection means for overlying said member accepting means, wherein said projecting member means is constrained to move vertically intermediate of said member accepting means and said first overlying projection means.

3. The apparatus according to claim 2 wherein said fixed frame means further includes a second overlying projecting means for bounding said vertically extending slot means.

4. The apparatus according to claim 3 wherein said member accepting means and said vertically extending slot means are generally vertically aligned on said fixed frame means.

5. The apparatus according to claim 4 wherein said apparatus further includes selectively engageable locking means for selectively locking said first and second frame means in fixed relation in a range of selectable vertical elevations.

6. The apparatus according to claim 5 wherein said locking means comprises means for engaging said second overlying projecting means.

7. The apparatus according to claim 6 wherein said spaced member accepting means comprises a plurality of spaced tab projections, each said tab projection extending outwardly and upwardly.

8. The apparatus according to claim 7 wherein said fixed frame means comprises a first upright member and a second upright member spaced therefrom, said first and second upright members including said first and second member accepting means respectively, and first and second vertically extending slot means respectively, and wherein said movable frame means includes first and second projecting member means for engaging said member accepting means in said first and second upright members, and said movable frame means further includes first and second slot engaging member means for engaging said vertically extending slot means in said first and second members respectively.

9. The apparatus according to claim 8 wherein said first and second upright members include first and second walls respectively, said first and second walls extending generally vertically and in an outward direction from said support surface, and wherein said first and second overlying projection means on said first and second upright members extend inwardly relative of said first and second wall means respectively, and wherein said first and second projecting member means and said first engaging member means are constrained to move vertically between said first and second walls respectively.

10. The apparatus according to claim 9 wherein said selectively engageable locking means includes first and second inwardly extending clamping members on said movable frame means, said first and second clamping members overlying outwardly said first and second slot engaging means respectively, said first and second clamping members selectively movable generally horizontally to clamp said overlying projections of said first and second upright members between said respective first and second clamping members and said respective first and second slot engaging member means.

11. The apparatus according to claim 10 wherein said fixed frame means further includes a top wall member and a bottom wall member extending between top and bottom areas of said first and second upright members respectively, said bottom member including means for preventing passage of said slot engaging member means, whereby disengagement of said fixed and movable frame means at a lower vertical extreme of relative movement is prevented.

12. The apparatus according to claim 11 wherein first and second clearance openings extend between said top wall member and said first and second upright members respectively, and wherein said first and second upright members include first and second clearance areas respectively between the respective first and second overlying projections of said first and second upright members, and wherein said first and second projecting member means are accepted into said first and second clearance opening respectively, and said first and second slot engaging member means are accepted into said first and second clearance areas respectively, to engage said fixed frame means and movable frame means into slidable engagement.

13. The apparatus according to claim 12 and further comprising selectively removable first and second closure members for closing said first and second clearance areas respectively, whereby disengagement of said engaged fixed and movable frame means is prevented.

14. The apparatus according to claim 13 wherein said movable frame means includes first and second bracket members disposed outwardly of said first and second slot engaging member means respectively, and wherein said first and second clamping members extend in threaded engagement through said first and second bracket members respectively.

15. The apparatus according to claim 14 and further comprising handle means in connection with a lower portion of said movable frame means for manually moving said movable frame means.

16. The apparatus according to claim 15 wherein said first and second projecting member means and said first and second slot engaging member means include generally horizontally extending rod members.

17. The apparatus according to claim 16 wherein said first and second upright members include first and second inward extending back flange surfaces respectively, said respective back flange surfaces inwardly bounding said vertically extending slot means and said member accepting means on said respective first and second upright members.

18. The apparatus according to claim 17 and further comprising at least one flange portion extending horizontally outward from said fixed frame means, said flange portion adapted for accepting fastening means for engaging said fixed frame means with said support surface.

19. A vertically adjustable striking bag support apparatus comprising:

a fixed frame means, said fixed frame means including:

first and second spaced upright members, each said upright member including a first side wall, a back flange surface extending inwardly from said first side wall, a plurality of vertically spaced tab projections extending outwardly and upwardly relative of said back flange surface, said tab projections adjacent a first end of said upright member, an inward extending projection extending inwardly from said side wall and generally parallel of sad back flange surface, said inward extending projection adjacent a second end of said upright member and bounding a slot area;

a movable frame means, said movable frame means including: an arm portion, said arm portion extending from said movable frame means in said outwardly direction, said arm portion adapted for holding a platform and striking bag in supported relation therewith, a pair of first projection members each adapted for selectively engaging a tab projection on an upright member, and a pair of second projection members each adapted for acceptance and vertical movement in said slot area of an adjacent upright member.

20. The apparatus according to claim 19 wherein said upright members each further include a further projection extending longitudinally on said upright member and overlying said tab projections, said further projections disposed outwardly from said tab projections wherein said first projecting members are enabled to move longitudinally between said tab projections and said further projection.

21. A vertically adjustable striking bag support apparatus, comprising:

a fixed frame, said fixed frame adapted for attachment to a generally vertically extending support surface;

said fixed frame including a vertically extending slot in a lower portion thereof, and a plurality of vertically spaced tab projection on an upper portion thereof;

a movable frame adapted for vertical movement on said fixed frame, said movable frame including at least one arm portion, said arm portion extending from said movable frame in a direction away from said support surface, said arm portion adapted for holding a platform and striking bag in supported relation therewith;

said, movable frame including a slot engaging member engaged in said slot and adapted for vertical movement therein;

said movable frame further including a projection member on upper portion thereof for selective engagement with said spaced tab projections, whereby said projecting member is held in supported relation in said tab projections at a selected vertical evaluation.

* * * * *